US008950960B2

(12) United States Patent
Onuki

(10) Patent No.: US 8,950,960 B2
(45) Date of Patent: Feb. 10, 2015

(54) RECORDING APPARATUS AND MEDIUM STORAGE DEVICE

(71) Applicant: Canon Kabushiki Kaisha, Tokyo (JP)

(72) Inventor: Kazuhiko Onuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/048,315

(22) Filed: Oct. 8, 2013

(65) Prior Publication Data

US 2014/0037358 A1 Feb. 6, 2014

Related U.S. Application Data

(63) Continuation of application No. 12/022,799, filed on Jan. 30, 2008, now Pat. No. 8,579,527.

(30) Foreign Application Priority Data

Jan. 31, 2007 (JP) ..... 2007-021418

(51) Int. Cl.

| | |
|---|---|
| ***B65H 31/24*** | (2006.01) |
| ***B65H 31/26*** | (2006.01) |
| ***B41J 15/02*** | (2006.01) |
| ***B41J 3/407*** | (2006.01) |
| ***B41J 13/00*** | (2006.01) |
| ***B41J 13/10*** | (2006.01) |
| ***B65H 31/20*** | (2006.01) |

(52) U.S. Cl.

CPC ..... *B41J 15/02* (2013.01); *B41J 3/4078* (2013.01); *B41J 13/0072* (2013.01); *B41J 13/106* (2013.01); *B65H 31/20* (2013.01); *B65H 2405/1116* (2013.01); *B65H 2701/11312* (2013.01); *B65H 2801/36* (2013.01)

USPC ..... 400/647; 400/646; 271/175; 271/213

(58) Field of Classification Search

CPC ..... B65H 31/20; B65H 2405/11151; B65H 2405/11152; B65H 2405/1116; B65H 2701/11312

USPC ..... 400/646, 647, 647.1; 271/207, 213, 271/223, 175; 347/104

See application file for complete search history.

(56) References Cited

U.S. PATENT DOCUMENTS 5,188,352 A * 2/1993 Bartman et al. ..... 271/175
6,568,865 B1 * 5/2003 Fujioka et al. ..... 400/647.1

FOREIGN PATENT DOCUMENTS

JP 2006036368 A * 2/2006 ..... B65H 31/20
JP 2006168898 A * 6/2006 ..... B65H 15/00
JP 2006224557 A * 8/2006 ..... B41J 15/04
JP 2007314338 A * 12/2007 ..... B65H 31/00

* cited by examiner

*Primary Examiner* — Daniel J Colilla
(74) *Attorney, Agent, or Firm* — Canon U.S.A., Inc. IP Division

(57) ABSTRACT

A movable rod member is provided that changes the shape of a medium receiver of a medium storage portion by changing the location of the movable rod member. The location of the movable rod member is changed in accordance with the condition of a medium, so as to change a method of storing the medium.

24 Claims, 16 Drawing Sheets

RECORDING APPARATUS AND MEDIUM STORAGE DEVICE

CROSS-REFERENCE TO RELATED APPLICATIONS

This application is a continuation of U.S. patent application Ser. No. 12/022,799 filed Jan. 30, 2008, which claims the benefit of Japanese Application No. 2007-021418 filed Jan. 31, 2007, all of which are hereby incorporated by reference herein in their entirety.

BACKGROUND OF THE INVENTION

1. Field of the Invention

The present invention relates to a medium storage device that stores a medium ejected from a recording apparatus that performs recording on a long sheet, for banner printing with a copier or for recording with a wide-format printer. The present invention also relates to a recording apparatus having the medium storage device.

2. Description of the Related Art

Hitherto, in a case of a recording apparatus that performs recording on a long medium (hereinafter, such a long medium is referred to merely as a medium), for banner printing with a copier or for recording with a wide-format printer, a medium to be used is large, and hence, a method of storing such a medium has to consider a manner of handling the recorded medium.

Japanese Patent Laid-Open No. 2003-95511 describes a method of storing a plurality of recorded media by substantially directly stacking the media in an ejected medium storage portion. Also, Japanese Patent Laid-Open No. 10-120275 describes a method in which recorded media are hung to both sides of a wall of an ejected medium storage portion, and are stacked.

Herein, the details of Japanese Patent Laid-Open No. 10-120275 are described with reference to FIGS. 14 to 16. FIGS. 14 to 16 are side views of a printer with the ejected medium storage portion. In FIG. 14, a printer body 101 and a rolled medium M101 that is recorded in the printer body 101 are illustrated. The medium M101 is strongly curled downward because of core set or the like. An ejection port 101*a* ejects the recorded medium M101 from the printer body 101. A pedestal 102 supports the printer body 101. Casters 102*a* and 102*b* are provided below the pedestal 102. The casters 102*a* and 102*b* are in contact with a floor face, and easily move the printer body 101. An ejected medium storage portion 104 stores the medium M101 ejected from the ejection port 101*a*. The medium M101 ejected from the ejection port 101*a* is curled downward because of the core set. Due to the curl, the leading edge of the medium M101 enters the ejected medium storage portion 104, and the medium M101 is finally stored as shown in FIG. 15 so as to be folded at an upper end 104*a* of the ejected medium storage portion 104. The second and later media are stored similarly, and thus, a plurality of media can be stored. That is, in the method of storing the ejected medium, the leading edge of the medium is guided to the ejected medium storing portion, a part of the medium not stored in the ejected medium storing portion protrudes from a wall of the ejected medium storing portion because of a conveying force urged by a part near the trailing edge of the medium, so that the medium is hung to the outside of the ejected medium storing portion.

However, the recording apparatus of the related art has problems as follows. First, if the recorded media are substantially directly stacked in the ejected medium storing portion, a large space is necessary in front of the apparatus. Next, the ejected medium storing portion, in which the media are stacked so as to be hung on both sides of the wall of the ejected medium storing portion, may not store a medium M102 as shown in FIG. 16. The medium M102 is merely slightly curled downward because, for example, the core set is less remained, or the medium M102 has a high stiffness, and hence, the leading edge of the medium M102 does not enter the ejected medium storage portion 104. The medium M102 may fall on a floor outside the ejected medium storage portion accordingly.

SUMMARY OF THE INVENTION

The present invention provides a recording apparatus capable of reliably stacking and storing ejected media using a small space regardless of the stiffness of the media.

The present invention provides a recording apparatus including a recording portion configured to perform recording on a medium, a medium-ejecting portion configured to eject the medium recorded by the recording portion, a medium-receiving member configured to face a recording surface of the medium ejected by the medium-ejecting portion, and to stack and house the medium, a first holding member configured to hold an end of the medium-receiving member, a second holding member configured to hold the other end of the medium-receiving member, a rod member configured to change the posture of the medium-receiving member, the rod member being moved to a first position where the rod member does not come into contact with the medium-receiving member, and to a second position where the rod member comes into contact with the medium-receiving member, the second position being closer to the medium-ejecting portion than the first position, and a rod-holding member configured to hold the rod member at the first position or the second position. When the rod member is held at the second position, a substantially horizontal portion is provided at the medium-receiving member between a position where the medium-receiving member is held by the first holding member and a position where the medium-receiving member comes into contact with the rod member.

Further features of the present invention will become apparent from the following description of exemplary embodiments with reference to the attached drawings.

DESCRIPTION OF THE EMBODIMENTS

First Embodiment

Figure 1:
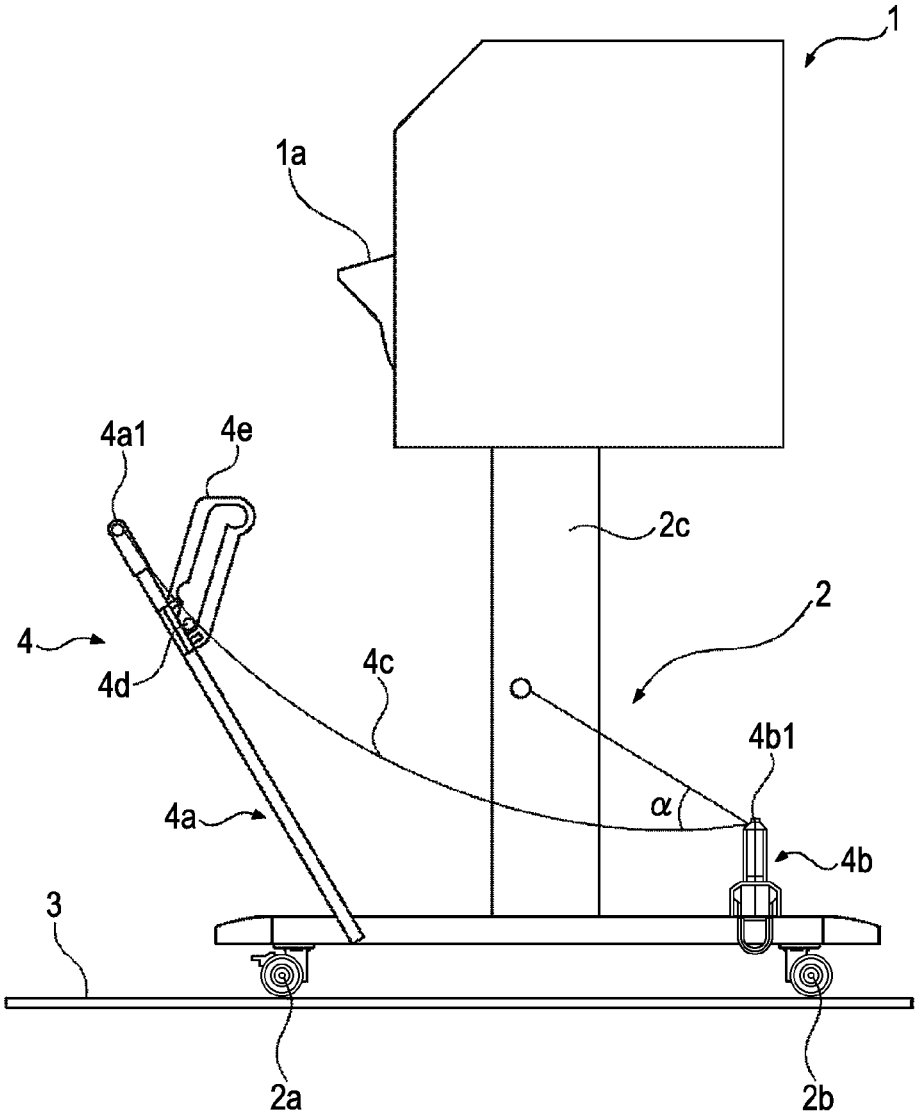
FIG. 1 is a side view showing a recording apparatus to which the present invention is applied, when a movable rod is located at a first position.

An exemplary embodiment of the present invention is described below with reference to the drawings. FIG. 1 is a side view showing a wide-format printer according to a first embodiment to which the present invention is applied. A printer body 1 has a recording portion (not shown) therein which performs recording on a medium. An ejection port 1*a* ejects the medium recorded by the recording portion to the outside of the printer body 1, the ejection port 1*a* serving as a medium-ejecting portion. A stand 2 supports the printer body 1. Casters 2*a* and 2*b* are provided below the stand 2. The casters 2*a* and 2*b* are in contact with a floor face 3, and easily move the printer body 1. A stand leg 2*c* supports the printer body 1. A storage device 4 (medium storage device) stores the medium ejected from the ejection port 1*a*. The storage device 4 includes a front holding member 4*a*, a rear holding member 4*b*, a medium receiver 4*c*, a movable rod 4*d* (displacement member), and a rod-holding base 4*e* (movable rod holding member). That is, the exemplary recording apparatus has the storage device. In FIG. 1, the movable rod 4*d* (displacement member) is held at a first position. The front holding member 4*a* and the rear holding member 4*b* are fixed to the stand 2. The medium receiver 4*c* can be made of cloth. An end of the medium receiver 4*c* is held by a medium receiver front fixing portion 4*a*1 (first holding member), and the other end thereof is held by the stand leg 2*c*. Both ends of the medium receiver 4*c* are held as described above, and an intermediate portion thereof is held by a medium regulator 4*b*1 (second holding member) of the rear holding member 4*b*. The medium receiver 4*c* is arranged such that an angle $\alpha$ is acute.

Figure 2:
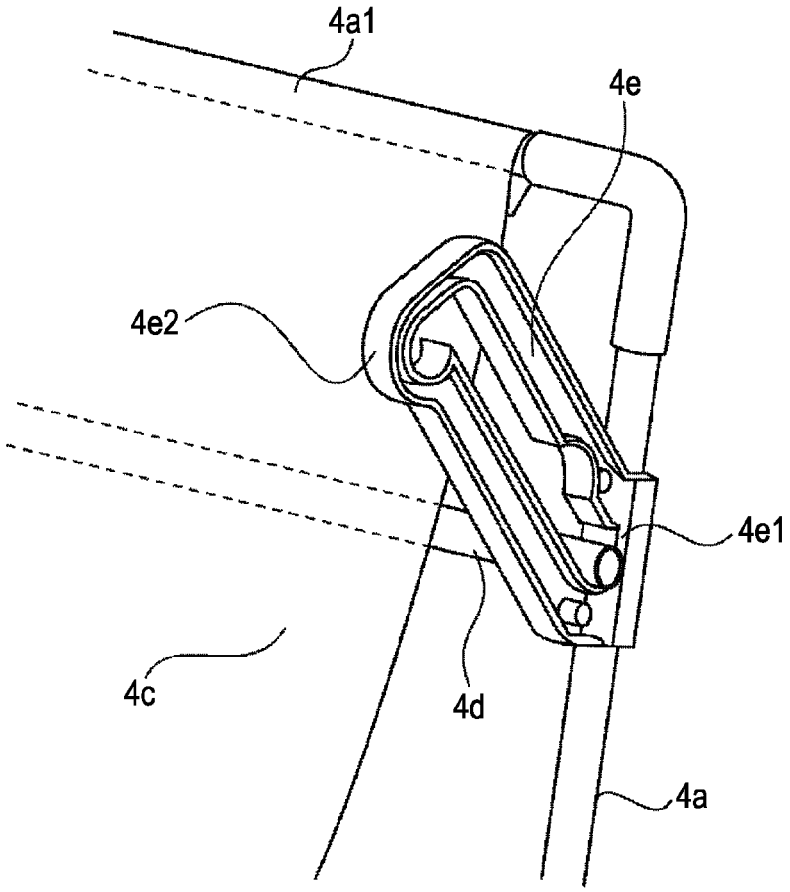
FIG. 2 is a partially enlarged perspective view showing a storage device in FIG. 1.

FIG. 2 is an enlarged perspective view showing the storage device 4. The rod-holding base 4*e* (movable rod holding member) is fixed to the front holding member 4*a*, and has a space at a center portion thereof. The movable rod 4*d* (displacement member) is arranged movably in the space. FIG. 2 illustrates that the movable rod 4*d* (displacement member) is located at a lowermost first position (4*e*1) of the rod-holding base 4*e* because of its weight. In this state, the movable rod 4*d* (displacement member) is located near the back side of the medium receiver 4*c* at a position not coming into contact with the medium receiver 4*c*. Accordingly, the shape of the medium receiver 4*c* between the medium receiver front fixing portion 4*a*1 (first holding member) of the front holding member 4*a* and the medium regulator 4*b*1 (second holding member) of the rear holding member 4*b* defines a continuous form without an inflection point. It is assumed that L represents a creeping length of the medium receiver 4*c* extending from the medium receiver front fixing portion 4*a*1 (first holding member) to the medium regulator 4*b*1 (second holding member).

Figure 3:
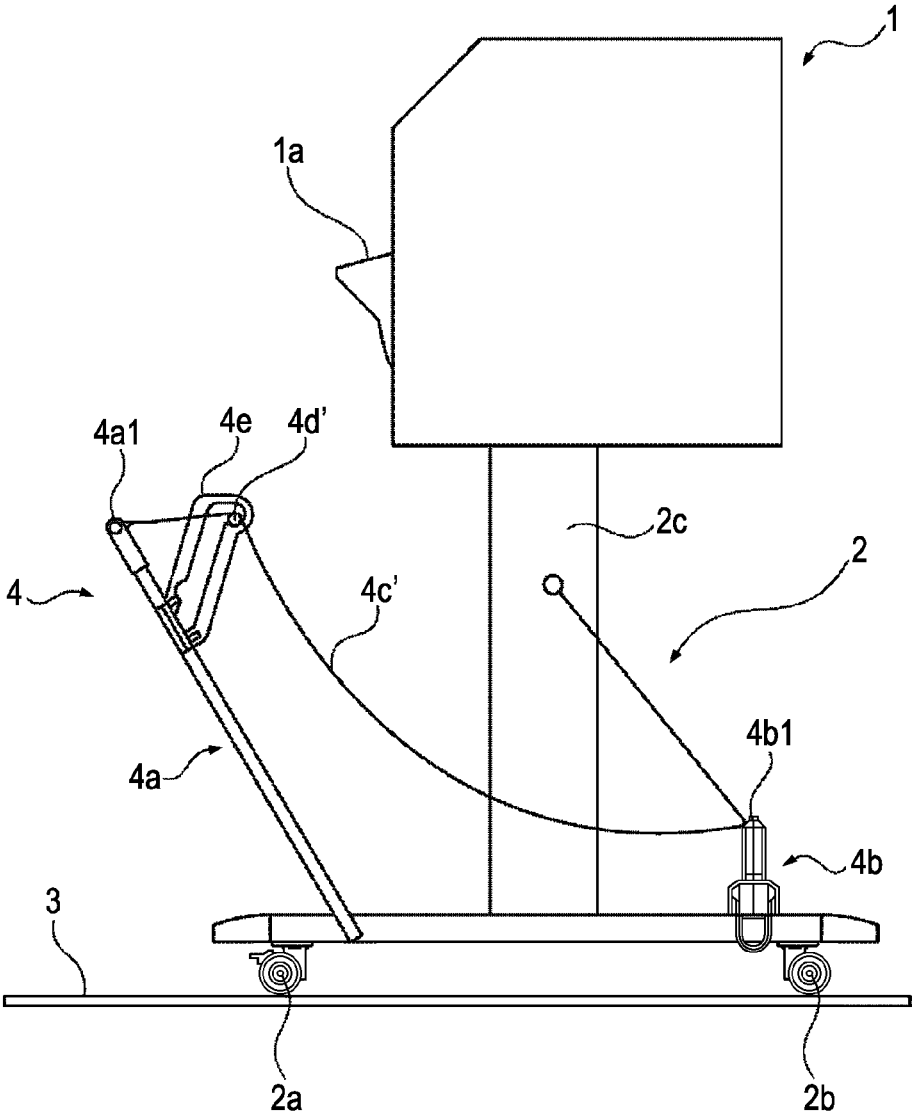
FIG. 3 is a side view showing the recording apparatus to which the present invention is applied, when the movable rod is located at a second position.

FIG. 3 illustrates that the movable rod 4*d* (displacement member) of the storage device 4 is moved to a second position (4*e*2) (hereinafter, the movable rod located at this position is referred to as a movable rod 4*d*'), and the posture of the medium receiver 4*c* is changed accordingly (hereinafter, the medium receiver in this state is referred to as a medium receiver 4*c*'). That is, since the movable rod 4*d*' is held at the second position (4*e*2) of the rod-holding base 4*e*, the movable rod 4*d*' comes into contact with the medium receiver 4*c*'. The posture of the medium receiver 4*c*' is changed accordingly, and a horizontal portion is provided between the medium receiver front fixing portion 4*a*1 (first holding member) and a position where the movable rod 4*d*' comes into contact with the medium receiver 4*c*'. Other configuration is similar to that shown in FIG. 1, and the description thereof is omitted.

Figure 4:
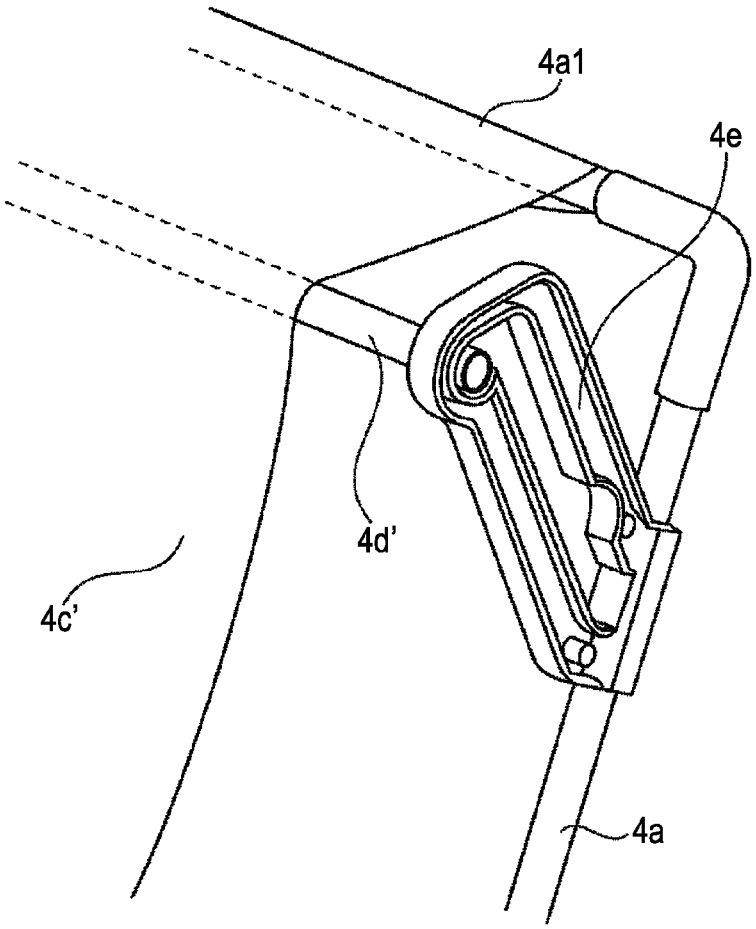
FIG. 4 is a partially enlarged perspective view showing the storage device in FIG. 3.

FIG. 4 is an enlarged perspective view showing the storage device 4 shown in FIG. 3. As compared with FIG. 2, FIG. 4 shows that the movable rod 4*d*' (displacement member) is moved to a recess (4*e*2) provided at an upper portion of the center space of the rod-holding base 4*e* (movable rod holding member), and held by the recess. The medium receiver 4*c*' at this time has a posture in which a part of the medium receiver 4*c*' is pushed up because the movable rod 4*d*' (displacement member) comes into contact with the medium receiver 4*c*'. Thus, the horizontal portion is provided between the medium receiver front fixing portion 4*a*1 (first holding member) and the position where the movable rod 4*d*' comes into contact with the medium receiver 4*c*'. In other words, the shape of the medium receiver 4*c*', which extends from the medium receiver front fixing portion 4*a*1 (first holding member) of the front holding member 4*a* to the medium regulator 4*b*1 (second holding member) of the rear holding member 4*b*, is changed into a posture having a protrusion (inflection point) at the movable rod 4*d*' (displacement member). Assuming that M represents a creeping length of the medium receiver 4*c* extending from the movable rod 4*d*' (displacement member) to the medium regulator 4*b*1 (second holding member), the relationship between M and above-described L is L>M.

Figure 5:
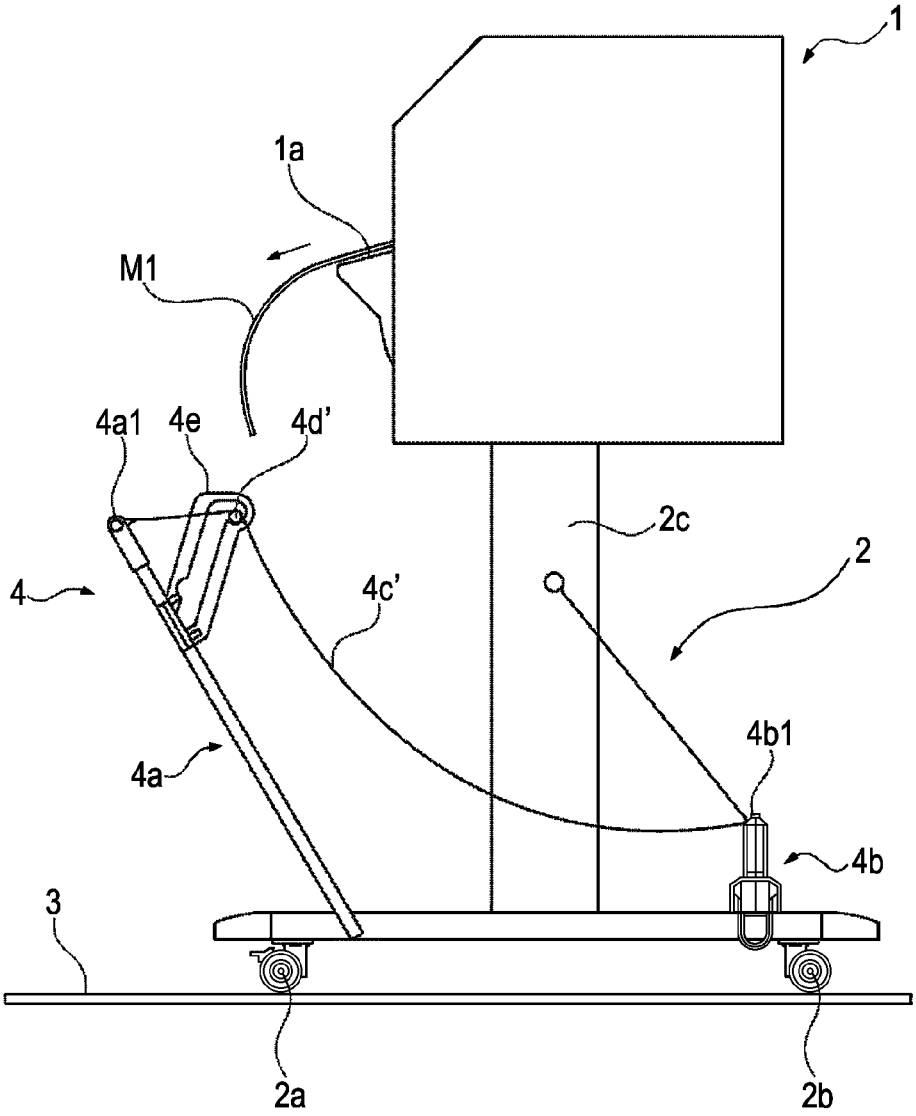
FIG. 5 is a side view showing the recording apparatus when the movable rod is located at the second position, at the beginning of ejecting a recorded medium.
Figure 6:
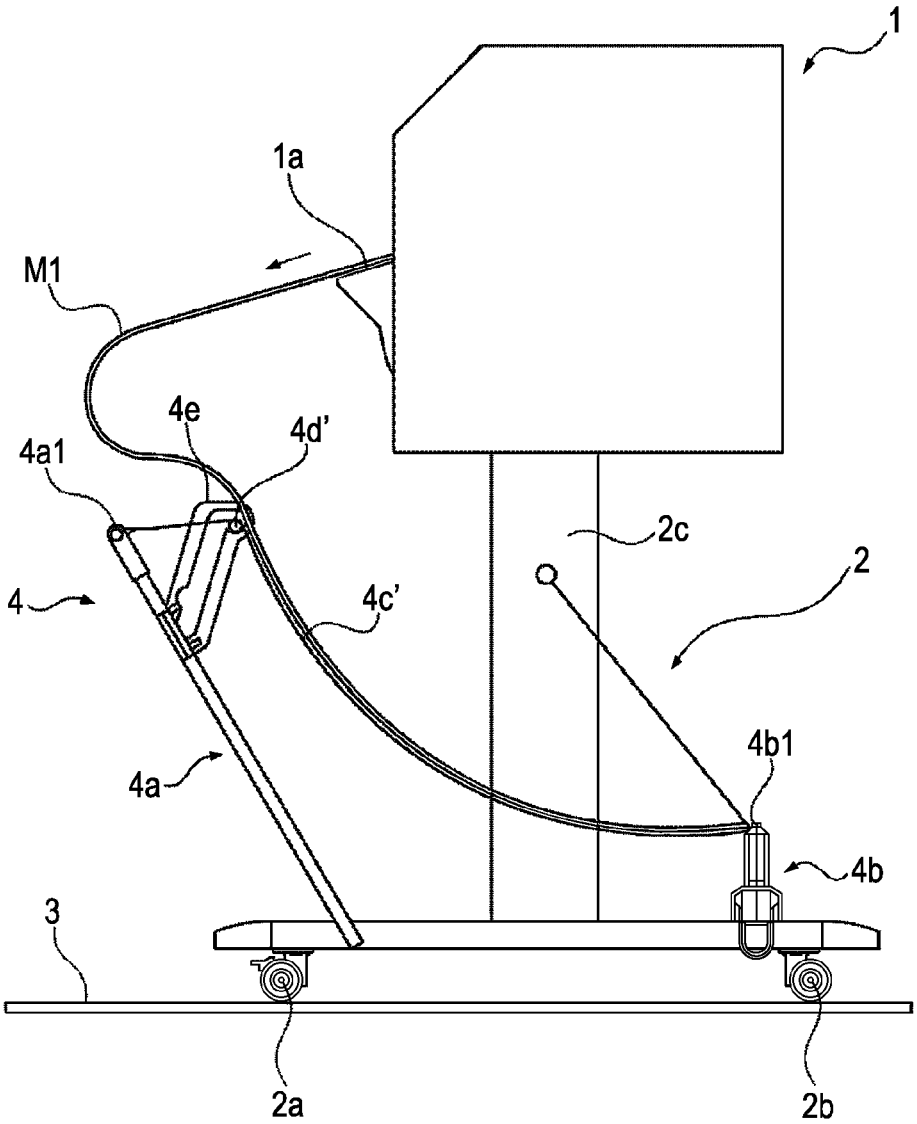
FIG. 6 is a side view showing the recording apparatus when the movable rod is located at the second position, in the middle of storing the recorded medium in the storage device.
Figure 7:
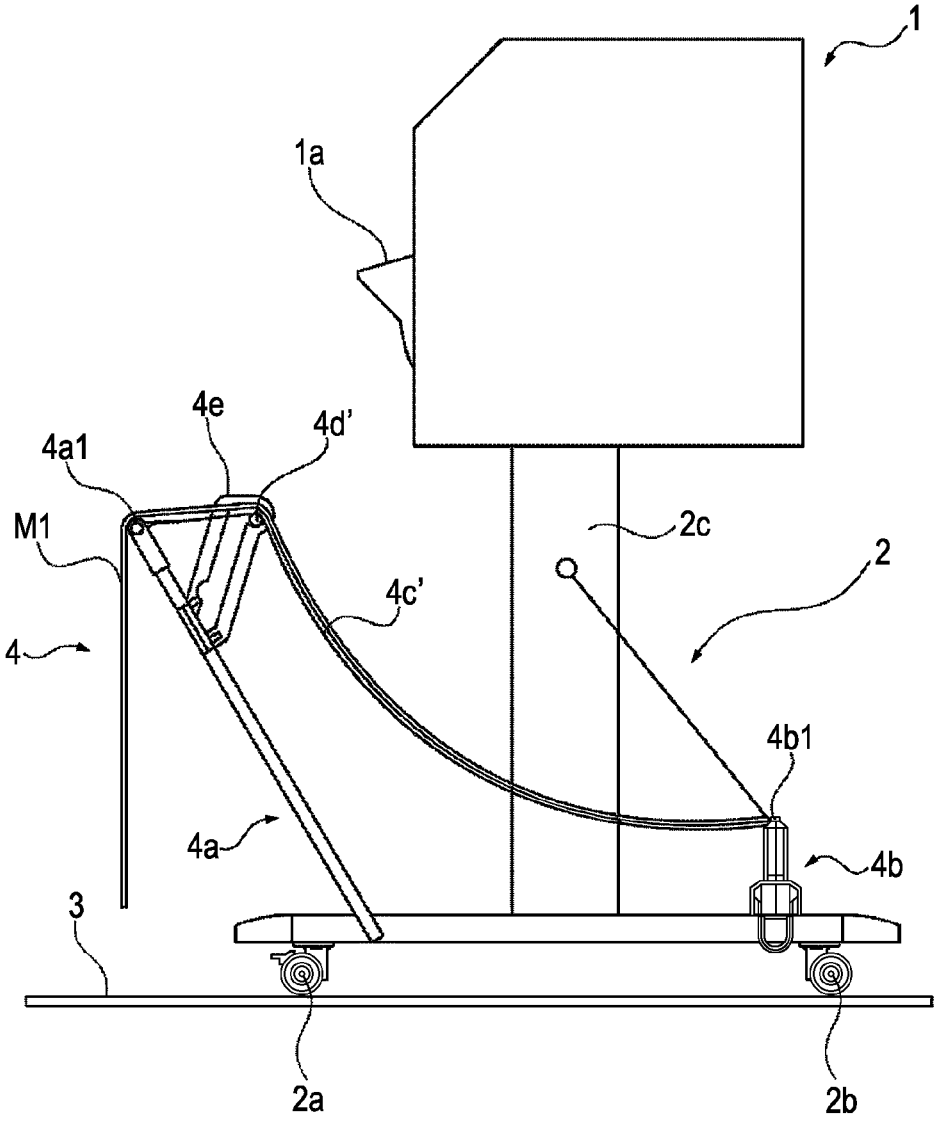
FIG. 7 is a side view showing the recording apparatus when the movable rod is located at the second position, after the recorded medium is stored in the storage device.

Next, the storage state of media for each case is described. FIG. 5 illustrates that a medium M1 is ejected from the ejection port 1*a*, or the medium-ejecting portion, of the printer body 1 in a direction indicated by an arrow, in the state as shown in FIGS. 3 and 4, that is, with the movable rod 4*d*' at the second position and the medium receiver 4*c*' selected. The medium M1 is curled downward because of the core set or the like. The leading edge of the medium M1 advances to the right side of the movable rod 4*d*' (displacement member), and hence, the medium M1 is stored in the medium receiver 4*c*'. At this time, the medium M1 recorded by the recording portion is stored so that the recording surface thereof faces the medium receiver 4*c*'. FIG. 6 illustrates that the medium M1 is further conveyed, and the leading edge has reached the medium regulator 4*b*1 (second holding member). In this state, the leading edge of the medium M1 comes into contact with the acute angle portion of the medium receiver 4*c*', and cannot advance farther. A part of the medium M1 near the trailing edge is still recorded by the recording portion, and the medium M1 is being ejected from the ejection port 1*a* of the printer body 1 in the direction indicated by the arrow. Accordingly, a center part of the medium M1 is markedly bulged to the left side in the drawing. FIG. 7 illustrates that recording in FIG. 6 has been completed, and the trailing edge of the medium M1 has been cut by a cutter (not shown) provided in the printer body 1. After the trailing edge of the medium M1 is cut, the medium M1 is bent near the movable rod 4*d*' (displacement member) because the medium M1 rapidly slips off in a direction indicated by an arrow in FIG. 6, and the trailing edge is moved to the left side of the storage device 4. Then, the medium M1 is held with a part of the medium M1 near the movable rod 4*d*' (displacement member) being suspended as its center. The second and later media are brought into the conditions similar to FIGS. 5 to 7. A plurality of media are thus stacked and housed in the storage device 4 with the medium receiver 4*c*', in an ordered manner. As described above, the plurality of recorded media can be stored in the storage device, and can be held so that an operator easily picks up the media. In addition, since the horizontal portion is provided between the medium receiver front fixing portion 4*a*1 (first holding member) and the movable rod 4*d*', the stacked media hardly falls. Further, if a medium is thin, bending of the medium becomes gentle.

Figure 8:
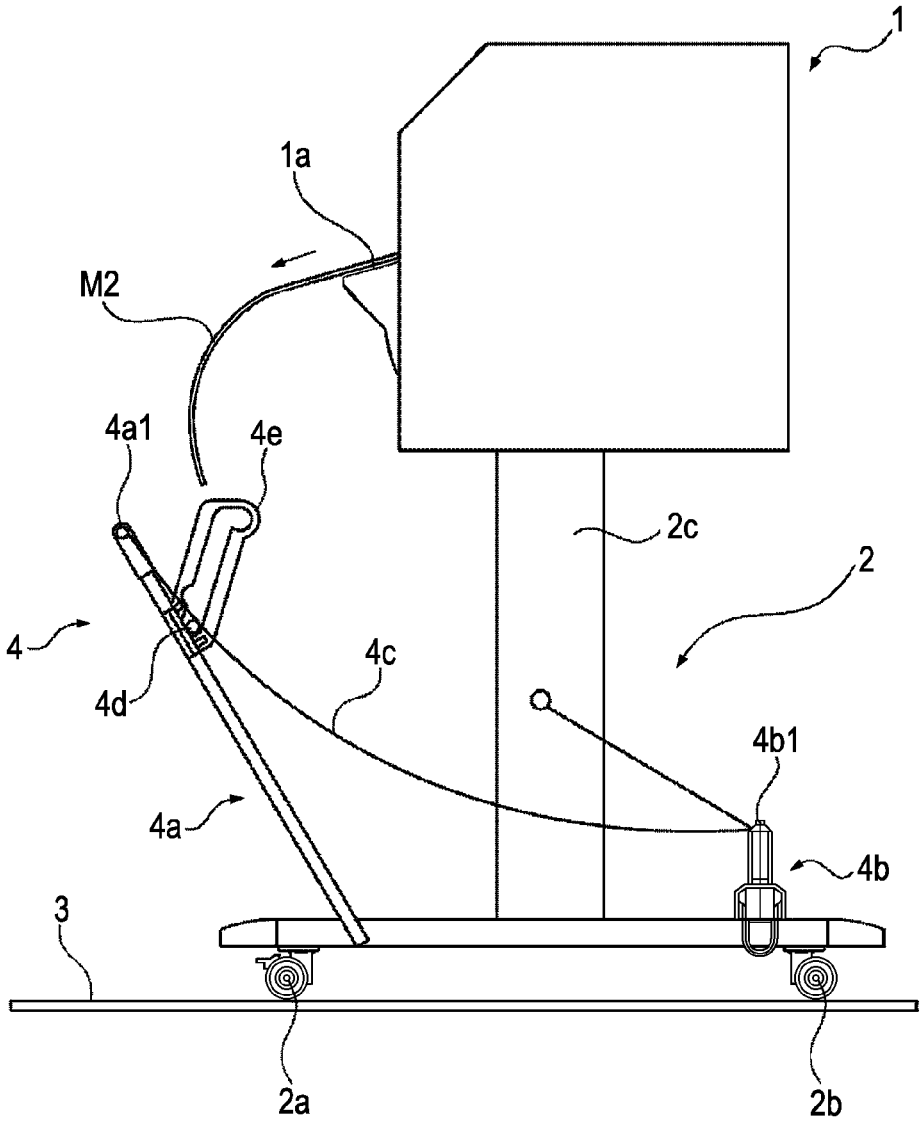
FIG. 8 is a side view showing the recording apparatus when the movable rod is located at the first position, at the beginning of ejecting a recorded medium.
Figure 9:
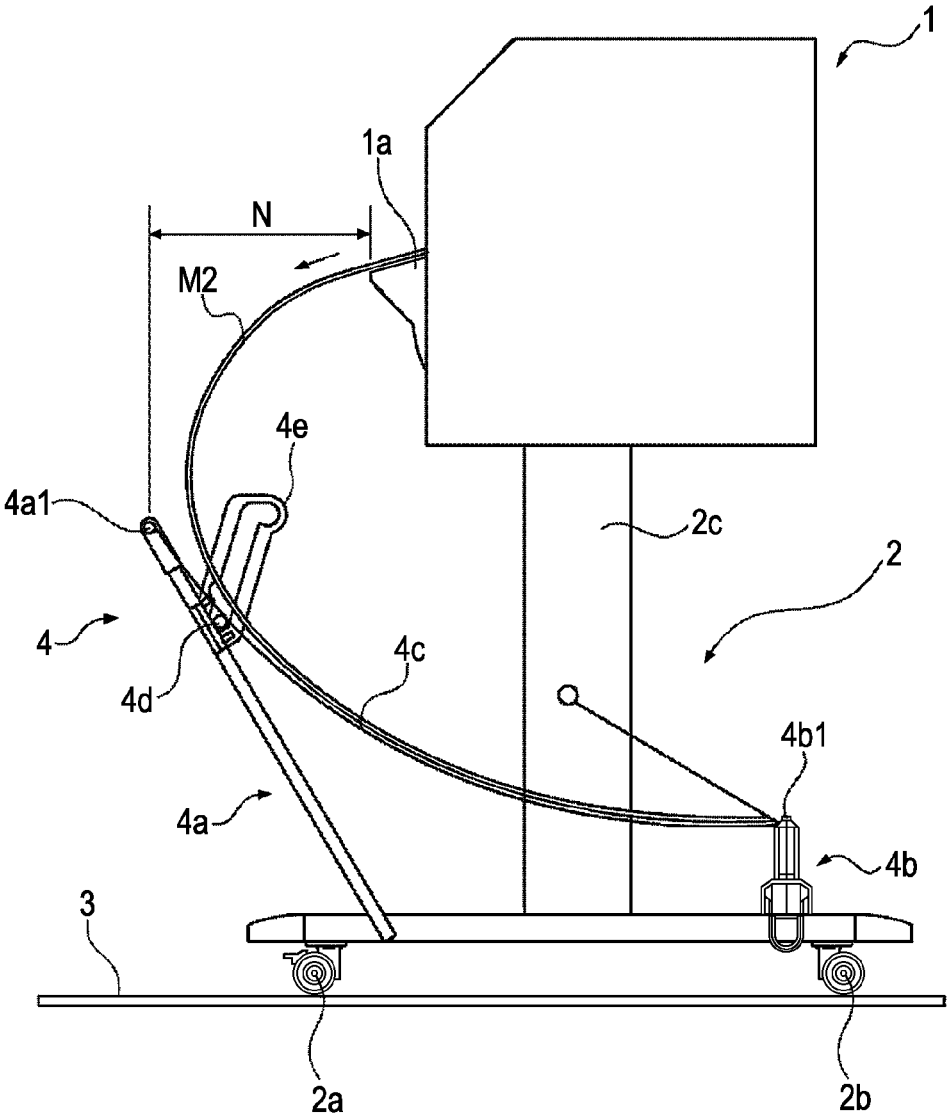
FIG. 9 is a side view showing the recording apparatus when the movable rod is located at the first position, in the middle of storing the recorded medium in the storage device.
Figure 10:
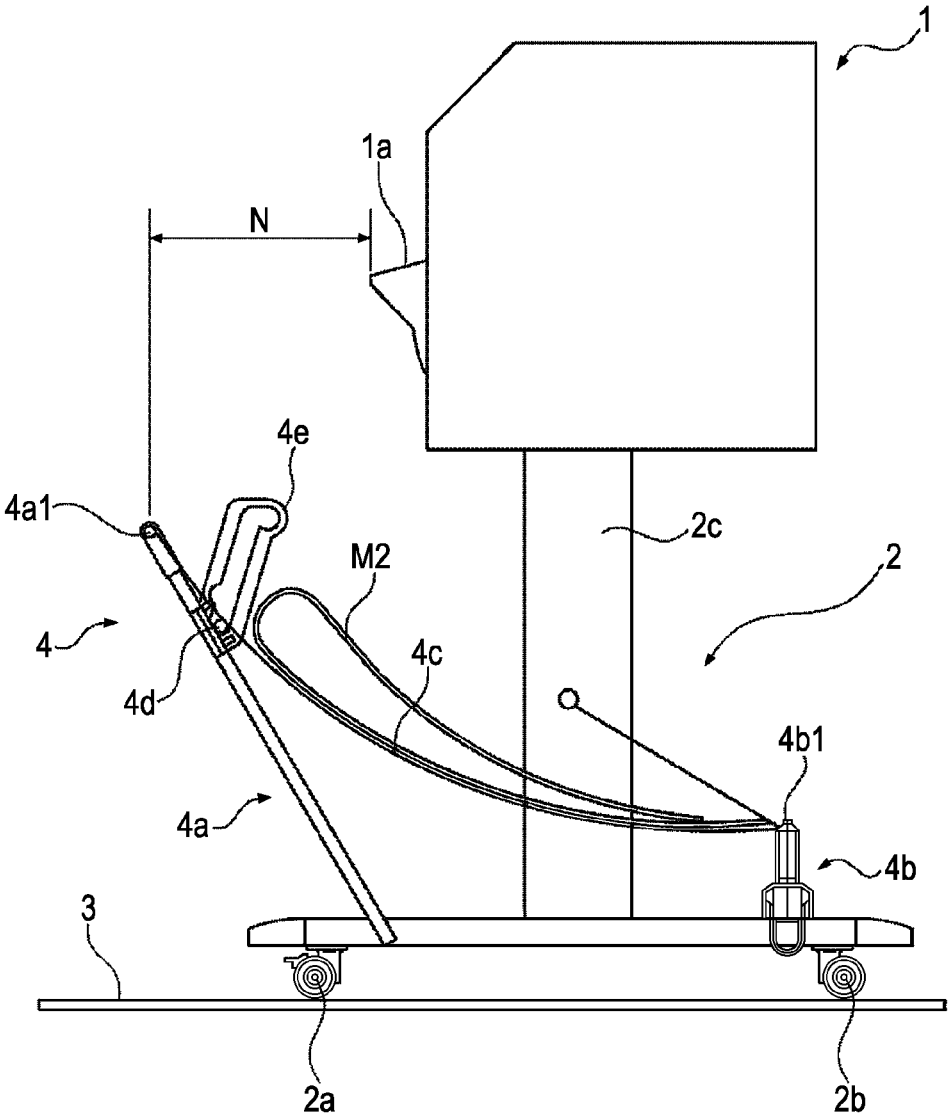
FIG. 10 is a side view showing the recording apparatus when the movable rod is located at the first position, after the recorded medium is stored in the storage device.

FIG. 8 illustrates that a medium M2 is ejected from the ejection port 1*a*, or the medium-ejecting portion, of the printer body 1 in a direction indicated by an arrow, in the state as shown in FIGS. 1 and 2, that is, with the movable rod 4*d* at the first position and the medium receiver 4*c* selected. The medium M2 is slightly curled downward because of the core set or the like. If the movable rod is located at the position 4*e*2 in FIG. 5, the leading edge of the medium M2 advances to the left side of the movable rod 4*d*' (displacement member), and hence, the medium M2 is not stored in the medium receiver 4*c*'. As a result, the medium M2 has fallen from the storage device 4 onto the floor face, and may become dirty. Therefore, for the medium M2 that is merely slightly curled downward because of the core set, the leading edge of the medium M2 is stored in the medium receiver 4*c* with the movable rod 4*d* (the medium receiver 4*c*). At this time, the medium M2 recorded by the recording portion is stored so that a recording surface thereof faces the medium receiver 4*c*. FIG. 9 illustrates that the medium M2 is further conveyed, and the leading edge has reached the medium regulator 4*b*1 (second holding member). In this state, the leading edge of the medium M2 comes into contact with the acute angle portion of the medium receiver 4*c*, and cannot advance farther. A part of the medium M2 near the trailing edge is still recorded, and the medium M2 is being ejected from the ejection port 1*a* of the printer body 1 in a direction indicated by an arrow. A distance N in FIG. 9 from the ejection port 1*a* of the printer body 1 to the medium receiver front fixing portion 4*a*1 (first holding member) is larger than that in FIG. 6. Hence, the bulge near the center of the medium M1 in FIG. 6 does not appear. FIG. 10 illustrates that recording in FIG. 9 has been completed, and the trailing edge of the medium M2 has been cut by a cutter (not shown) provided in the printer body 1. The medium M2 has fallen in a direction indicated by an arrow in FIG. 9. Since the distance N from the ejection port 1*a* of the printer body 1 to the medium receiver front fixing portion 4*a*1 (first holding member) is large, the trailing edge of the medium M2 is stored in the storage device 4. The second and later media are brought into the conditions similar to FIGS. 8 to 10. A plurality of media is thus stacked and housed on the medium receiver 4*c*. For the medium M2 that is merely slightly curled downward because of the core set, the plurality of media is not stored so that the operator easily picks up the media, unlike FIG. 7. The media, however, are reliably stored in the storage device 4, and the recorded media can be prevented from falling onto the floor face and becoming dirty.

Second Embodiment

Figure 11:
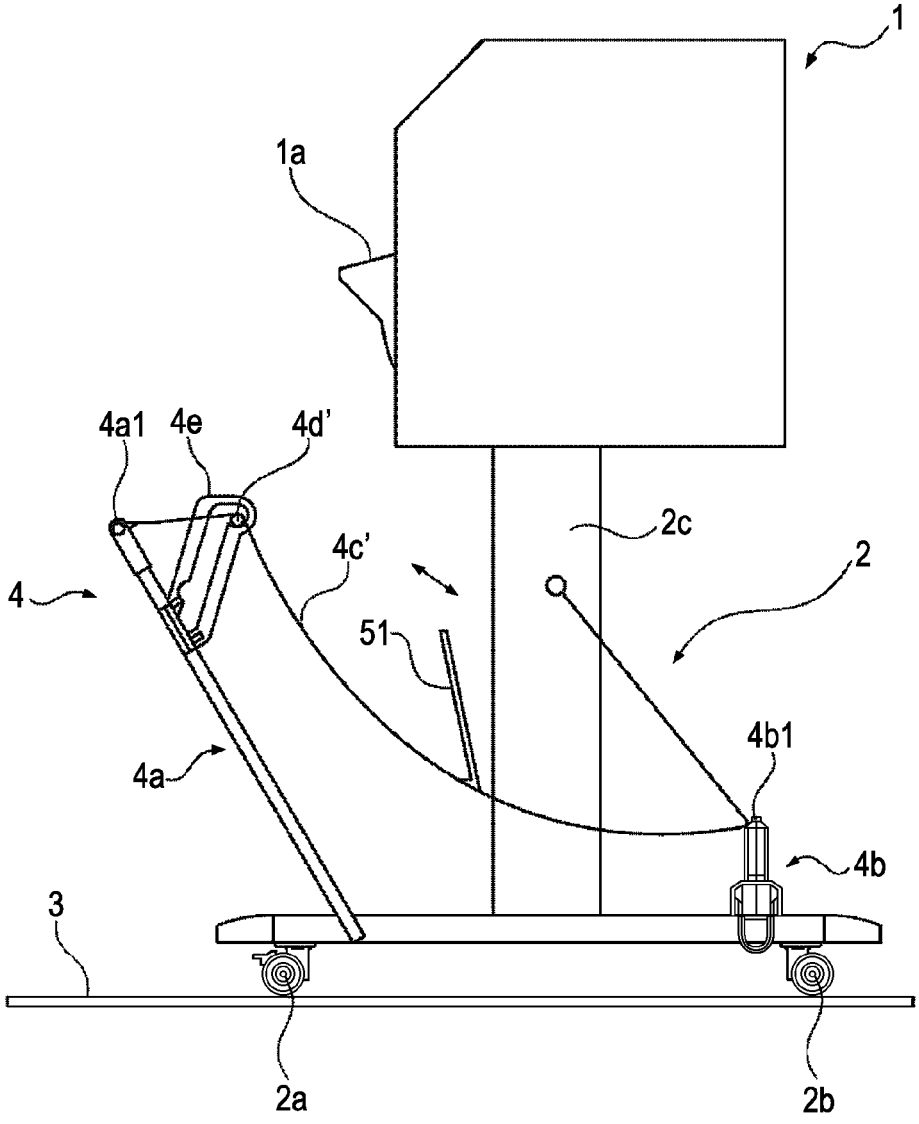
FIG. 11 is a side view showing a second embodiment of a recording apparatus to which the present invention is applied.
Figure 12:
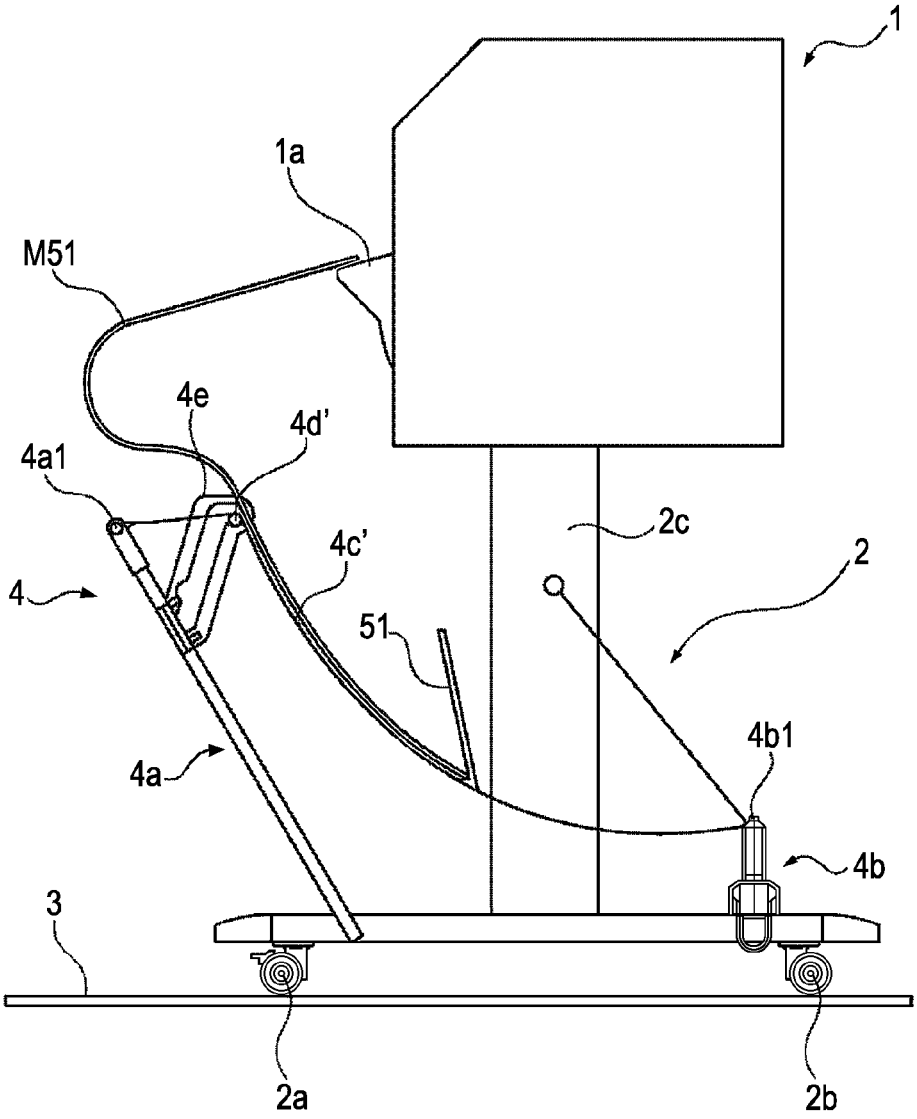
FIG. 12 is a side view showing the second embodiment of the recording apparatus to which the present invention is applied, in the middle of storing the recorded medium in the storage device.
Figure 13:
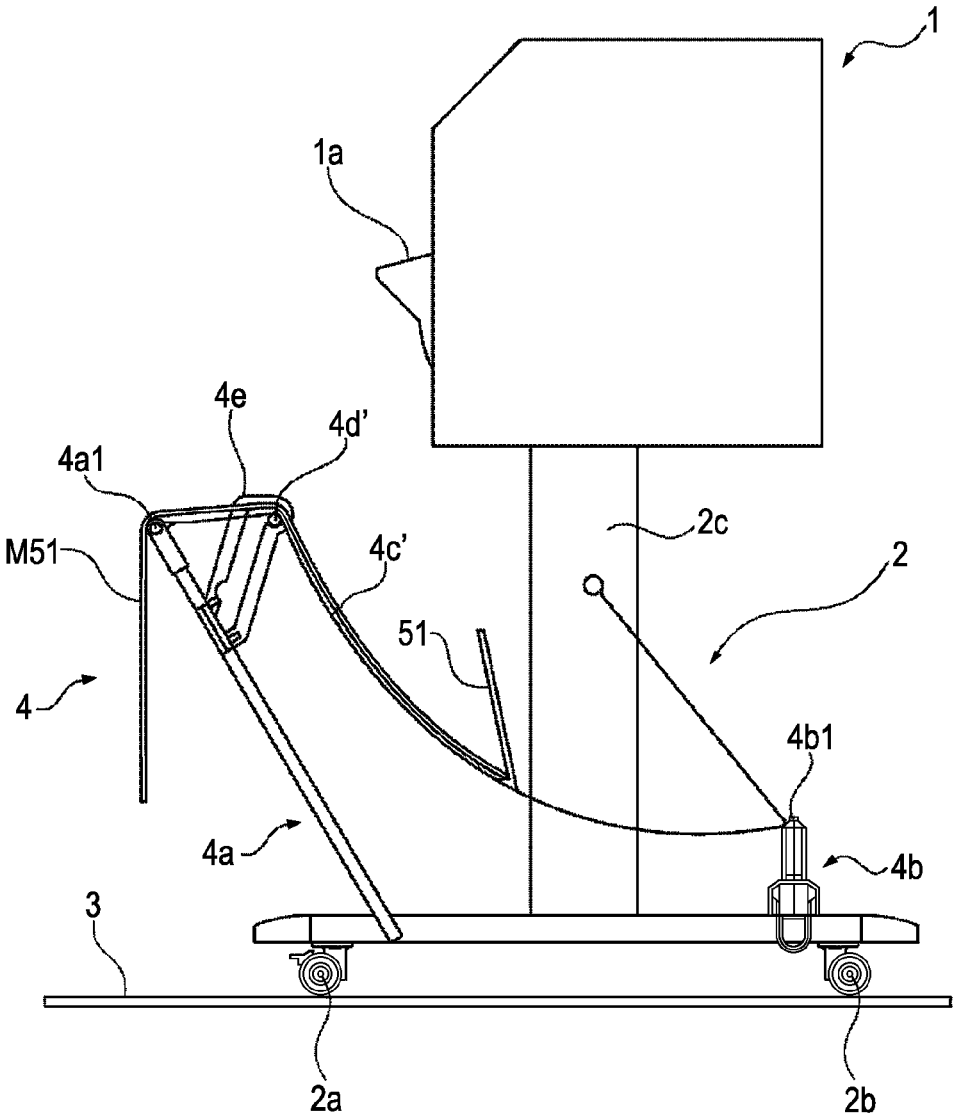
FIG. 13 is a side view showing the second embodiment of the recording apparatus to which the present invention is applied, after the recorded medium is stored in the storage device.
Figure 14:
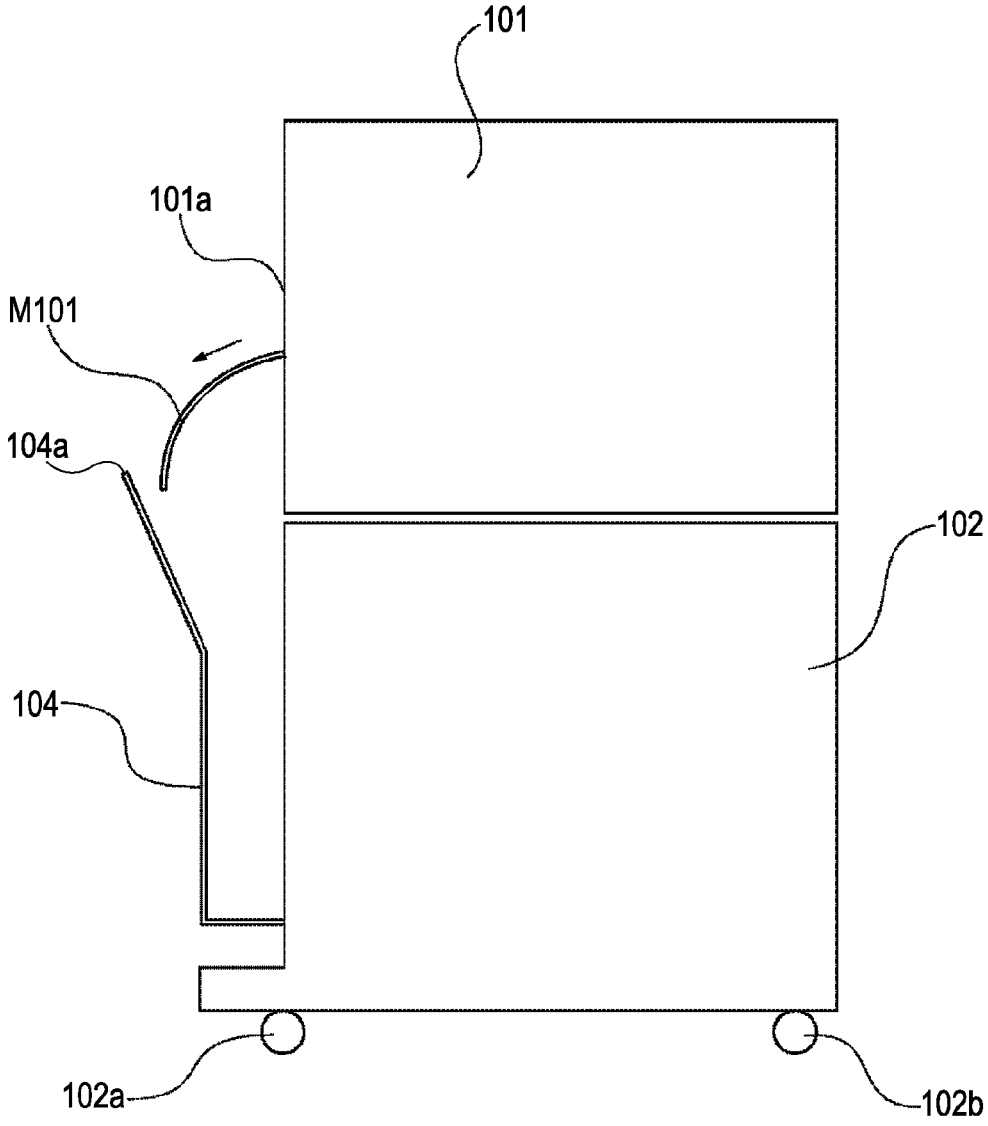
FIG. 14 PRIOR ART
FIG. 14 is a side view showing a copier of a related art, at the beginning of ejecting a recorded medium.
Figure 15:
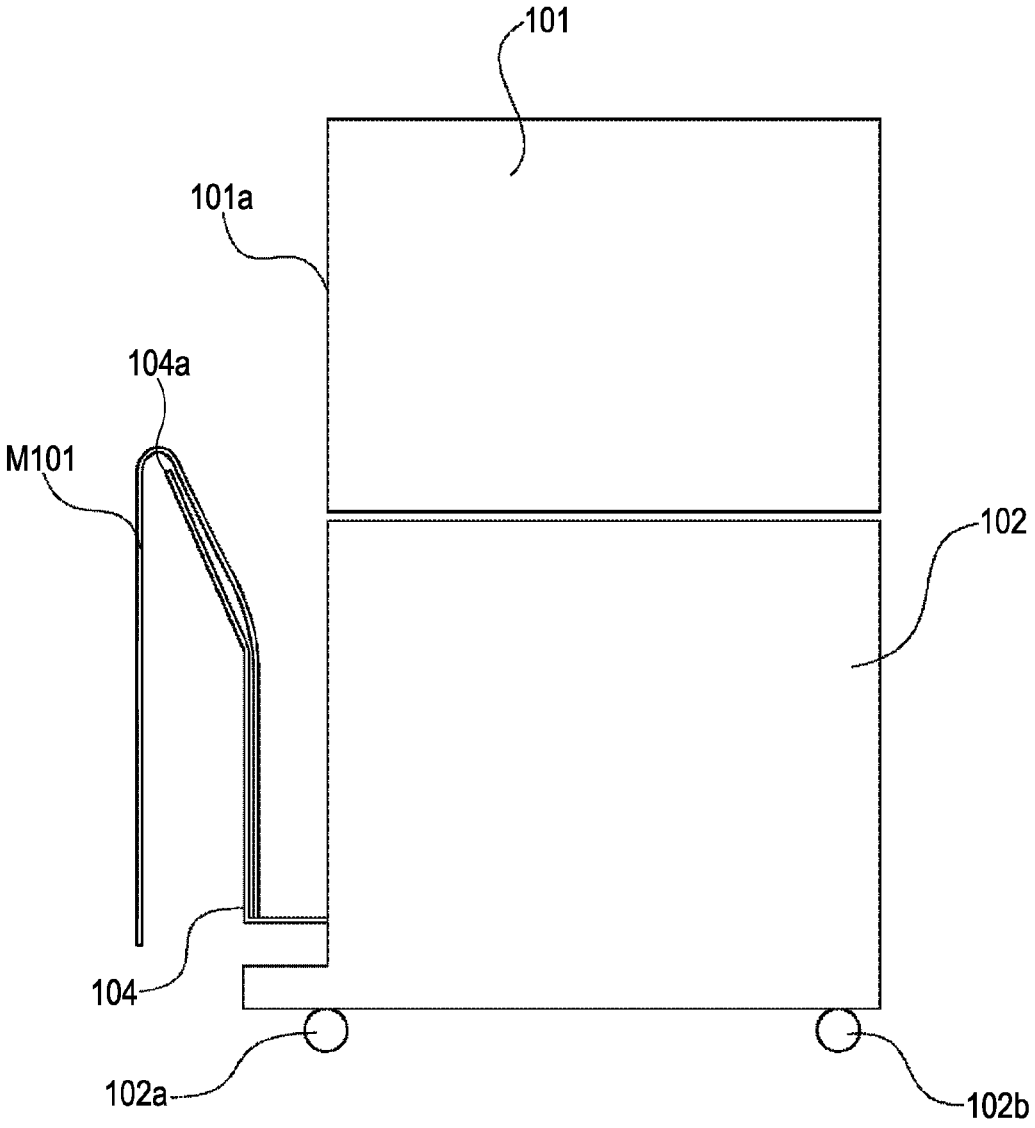
FIG. 15 PRIOR ART
FIG. 15 is a side view showing the copier of the related art, after the recorded medium is stored in the storage device.
Figure 16:
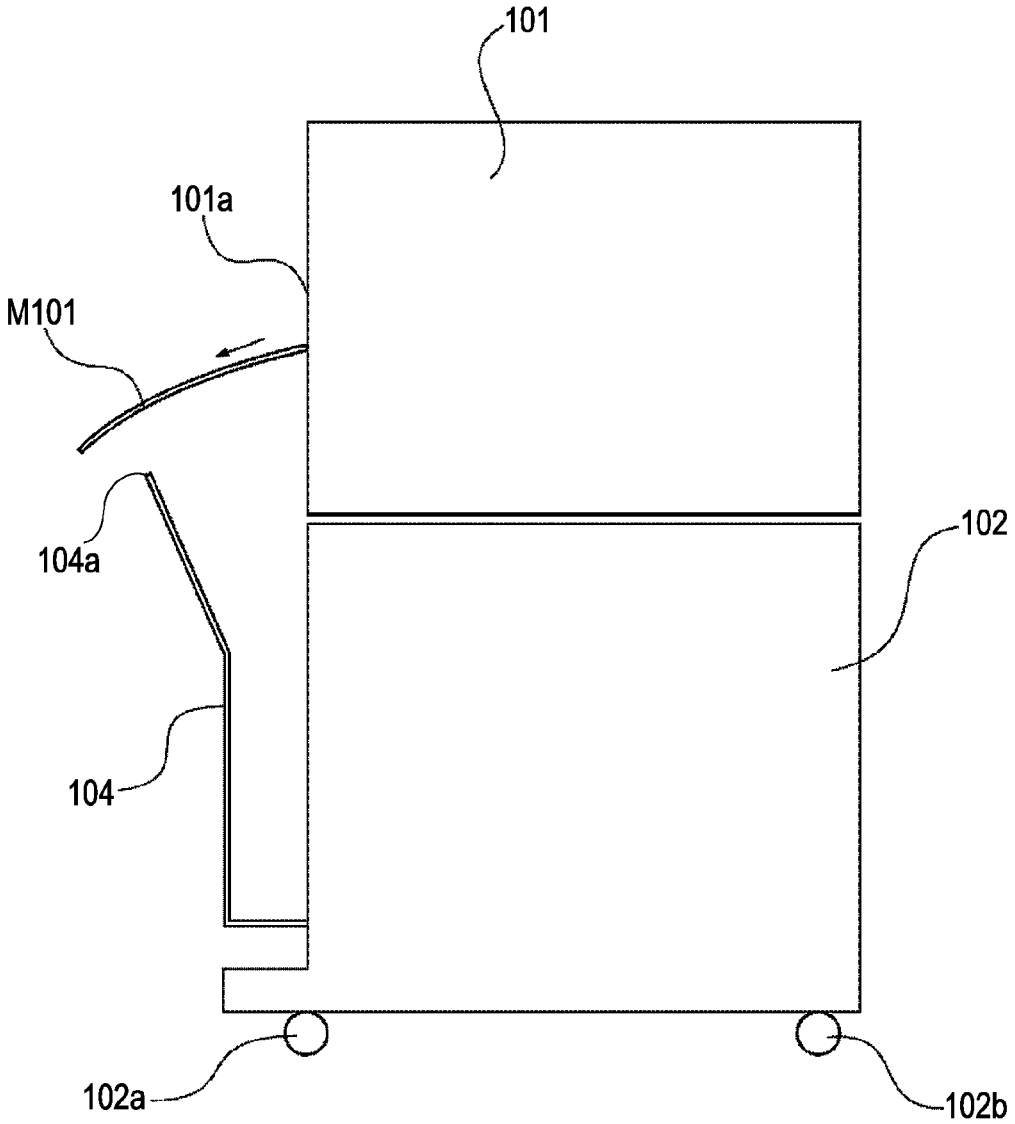
FIG. 16 PRIOR ART
FIG. 16 is a side view showing the copier of the related art, when the recorded medium is not stored in the storage device.

FIG. 11 is a side view showing a wide-format printer according to a second embodiment. As compared with the first embodiment, a stopper 51 is added. The stopper 51 is disposed on the medium receiver 4*c*', and is movable on the medium receiver 4*c*' in a forward direction (direction indicated by an arrow) of a medium. FIG. 12 illustrates that the leading edge of a medium M51 ejected from the ejection port 1*a* of the printer body 1 has reached an acute angle portion of the stopper 51. In this state, the leading edge of the medium M51 comes into contact with the acute angle portion of the stopper 51, and cannot advance farther. Recording on a part of the medium M51 near the trailing edge is completed, the trailing edge of the medium M51 is cut by a cutter, and the medium M51 starts slipping on a slope at the ejection port 1*a*. A center part of the medium M51 is markedly bulged to the left side in the drawing. FIG. 13 illustrates that the medium M51 is held with a part of the medium M51 near the movable rod 4*d*' (displacement member) being suspended at its center. After the condition in FIG. 12, the trailing edge of the medium M51 is bent near the movable rod 4*d*' (displacement member) because the medium M51 rapidly slips off the ejection port 1*a*, and the trailing edge is moved to the left side of the storage device 4. Then, the medium M51 is held with a part of the medium M51 near the movable rod 4*d*' (displacement member) being suspended at its center. The second and later media are brought into the conditions similar to FIGS. 12 to 13. A plurality of media is thus stacked and housed in the storage device with the medium receiver 4*c*', in an ordered manner. As described above, the plurality of recorded media can be stored in the storage device, and can be held so that the operator easily picks up the media. In particular, with the movable rod 4*d*' at the second position, by moving the stopper 51 corresponding to the size (length) of the media, the plurality of media can be stored and held in an ordered manner.

For the recorded media that are strongly curled downward because of the core set, the media can be stored in the storage device in a stacked manner, and hence, the recorded media can be easily picked up from the storage device. In contrast, for the recorded media that are merely slightly curled downward because of the core set, the recorded media can be reliably stored in the storage device by switching the shape of the media receiver of the storage device. Therefore, the recorded media can be prevented from falling onto the floor face and becoming dirty. Also, if the medium regulator is provided to be adjusted in the forward direction of the medium, media with a short length can be also stored in the storage device in a stacked manner. Thus, the recorded media can be easily picked up from the storage device.

While the movable rod is moved linearly from the first position to the second position in the above-described embodiments, the movable rod may be moved along a curve, for example, by rotating the movable rod about a given axis, or the movable rod may be moved through other motions. In addition, while the movable rod is manually moved by the operator, the movable rod may be automatically switched with a driver such as a motor corresponding to the type of medium, diameter of winding, and the method of recording. With this configuration, a problem caused by a failure in operation or an error in operation can be prevented from occurring.

Further, while the medium receiver is made of cloth, it is not limited thereto. For example, a plate-like medium receiver may be partly bent to form a protruding shape.

While the position of the stopper is manually moved by the operator, the position of the stopper may be automatically switched with a driver such as a motor corresponding to the length of media. With this configuration, a problem caused by a failure in operation or an error in operation can be prevented from occurring.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A recording apparatus comprising:

a recording unit configured to record an image on a medium and to eject the medium from an ejecting port, wherein the recording unit has a first side where the ejecting port is disposed, and a second side opposite to the first side;

a first holding member and a second holding member configured to hold a receiving member which receives a medium ejected from the ejecting port; and a rod holding unit configured to hold a rod, movably relative to the rod holding unit, at a first position or at a second position nearer to the ejecting port than the first position, wherein the second holding member is located nearer to the second side than the first holding member, wherein the rod holding unit is connected to a first holding unit having the first holding member, and wherein in a case where the rod is supported at the second position, the ejected medium is supported by the rod with the receiving member.

2. The recording apparatus according to claim 1, wherein in a case where the rod is supported at the second position, the ejected medium is supported by the first holding member and the rod with the receiving member.

3. The recording apparatus according to claim 1, wherein in a case where the rod is supported at the second position, a portion near to a trailing edge of the ejected medium is suspended from the receiving member.

4. The recording apparatus according to claim 1, wherein in a case where the rod is supported at the second position, a portion near to a leading edge of the ejected medium is supported by the receiving member between the rod and the second holding member.

5. The recording apparatus according to claim 1, wherein in a case where the rod is supported at the second position, the ejected medium drops over a portion, which is supported by the rod and the first holding member, of the receiving member.

6. The recording apparatus according to claim 1, further comprising a stopper configured to regulate a leading edge of the ejected medium.

7. The recording apparatus according to claim 6, wherein the stopper is movable on the receiving member.

8. The recording apparatus according to claim 1, wherein the receiving member is made of cloth.

9. The recording apparatus according to claim 1, further comprising a stand configured to support the recording unit and the first holding unit.

10. The recording apparatus according to claim 9, further comprising casters provided at the bottom of the stand and configured to support the stand.

11. The recording apparatus according to claim 10, wherein the first holding unit is supported by the stand at a position located under the recording unit.

12. The recording apparatus according to claim 1, wherein in a case where the rod is supported at the second position, a part of the receiving member is supported by the rod.

13. The recording apparatus according to claim 1, wherein in a case where the rod is supported at the second position, a portion of the receiving member between the first holding member and the rod is horizontal.

14. The recording apparatus according to claim 1, wherein in a case where the rod is supported at the second position, a height of the rod is substantially same as a height of the first holding member.

15. The recording apparatus according to claim 1, wherein in a case where the rod is supported at the first position, the medium ejected from the ejecting port is not supported by the rod with the receiving member.

16. The recording apparatus according to claim 1, wherein the second position is higher than the first position.

17. The recording apparatus according to claim 1, wherein in a case where the rod is supported at the second position, the ejected medium is bent near the rod and the trailing edge of the ejected medium is moved to the opposite side of the receiving unit after cutting the trailing edge of the ejected medium.

18. A recording apparatus comprising:

a recording unit configured to record an image on a medium and to eject the medium from an ejecting port, wherein the recording unit has a first side where the ejecting port is disposed, and a second side opposite to the first side;

a first holding member and a second holding member configured to hold a receiving member which receives a medium ejected from the ejecting port; and a rod holding unit configured to hold a rod, movably relative to the rod holding unit, at a first position or at a second position nearer to the ejecting port than the first position, wherein the second holding member is located nearer to the second side than the first holding member, wherein the rod holding unit is connected to a first holding unit having the first holding member, and wherein in a case where the rod is supported at the second position, a part of the receiving member is supported by the rod.

19. The recording apparatus according to claim 18, wherein in a case where the rod is supported at the second position, the ejected medium is supported by the first holding member and the rod with the receiving member.

20. The recording apparatus according to claim 18, wherein in a case where the rod is supported at the second position, a portion of near to a trailing edge of the medium is suspended from the receiving member.

21. The recording apparatus according to claim 18, wherein in a case where the rod is supported at the second position, a portion of near to a leading edge of the medium is supported by the receiving member between the rod and the second holding member.

22. The recording apparatus according to claim 18, wherein in a case where the rod is supported at the second position, the ejected medium drops over a portion, which is supported by the rod and the first holding member, of the receiving member.

23. The recording apparatus according to claim 18, further comprising a stopper configured to regulate a leading edge of the ejected medium.

24. The recording apparatus according to claim 18, wherein in a case where the rod is supported at the first position, the medium ejected from the ejecting port is not supported by the rod with the receiving member.

* * * * *